United States Patent [19]

Onstwedder, Jr.

[11] Patent Number: 4,864,956

[45] Date of Patent: Sep. 12, 1989

[54] YIELDABLE MOORING LINE FOR A BOAT

[76] Inventor: John Onstwedder, Jr., 811 Neff, Grosse Pointe City, Mich. 48230

[21] Appl. No.: 195,315

[22] Filed: May 18, 1988

[51] Int. Cl.[4] ..... B63B 21/00

[52] U.S. Cl. ..... 114/230; 267/69; 267/74; 114/293

[58] Field of Search ..... 114/230, 214, 215, 217, 114/216; 267/69, 73, 74; 119/109

[56] References Cited

U.S. PATENT DOCUMENTS

| | | | |
|---|---|---|---|
| Re. 25,372 | 4/1963 | Dick | 114/230 |
| 653,244 | 7/1900 | Jones | 114/230 |
| 843,543 | 2/1907 | Matsumoto | 114/294 |
| 869,130 | 10/1907 | Bierie | 114/216 |
| 1,094,610 | 4/1914 | Steinhauer | 114/230 |
| 2,552,424 | 5/1951 | Gorman | 114/230 |
| 2,561,487 | 7/1951 | Bailhe | 114/230 |
| 2,569,783 | 10/1951 | Smith | 114/230 |
| 2,924,448 | 2/1960 | Nantz | 267/74 |
| 2,930,339 | 3/1960 | Trnka | 114/230 |
| 2,938,492 | 5/1960 | Kulick | 114/230 |
| 2,996,033 | 8/1961 | Yordi | 114/230 |
| 3,011,818 | 12/1961 | Matthiessen | 267/73 |
| 3,018,494 | 1/1962 | Guido | 267/74 |
| 3,353,817 | 11/1967 | Bollinger | 114/215 |
| 3,462,960 | 8/1969 | Bruehl | 114/230 |
| 4,022,450 | 5/1977 | Smith, Jr. | 114/230 |
| 4,144,831 | 3/1979 | Heydolph | 114/230 |
| 4,200,052 | 4/1980 | Cunningham et al. | 114/230 |
| 4,250,827 | 2/1981 | Booker et al. | 114/230 |
| 4,297,963 | 11/1981 | Beacom | 114/230 |
| 4,529,388 | 7/1985 | Jones, deceased | 441/3 |
| 4,597,351 | 7/1986 | Brainard, II | 114/230 |
| 4,649,850 | 3/1987 | Akiba | 114/230 |

*Primary Examiner*—Sherman D. Basinger
*Assistant Examiner*—Edwin L. Swinehart
*Attorney, Agent, or Firm*—Dykema Gossett

[57] ABSTRACT

A yieldable mooring line for a boat comprises a coil spring with first and second spring key clevises connected to opposite ends of the spring and projecting therefrom. A chain at one end is connected to the first spring clevis. A line is removably anchored to the boat, and a snap-on is secured upon one end of the line which is removably connected to the other end of the chain. The second spring clevis is adapted for connection to a dock or piling.

14 Claims, 2 Drawing Sheets

FIG. 1
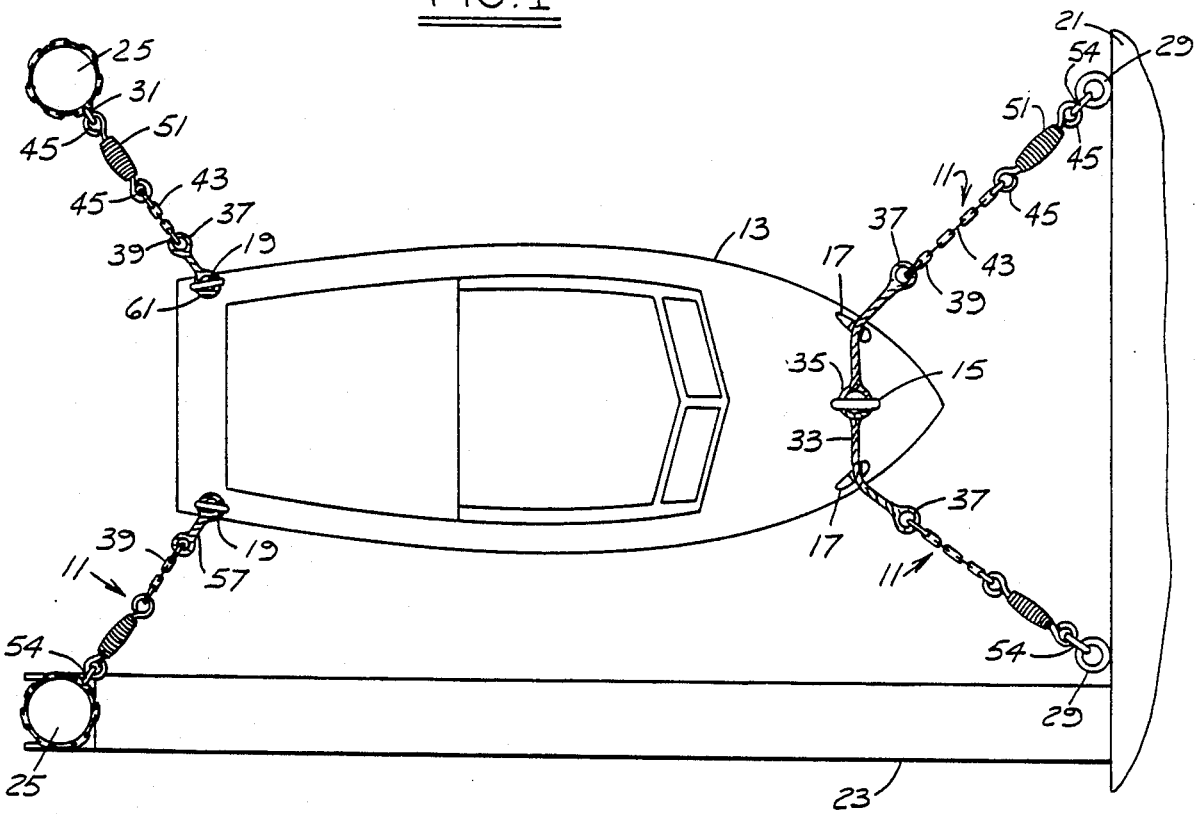
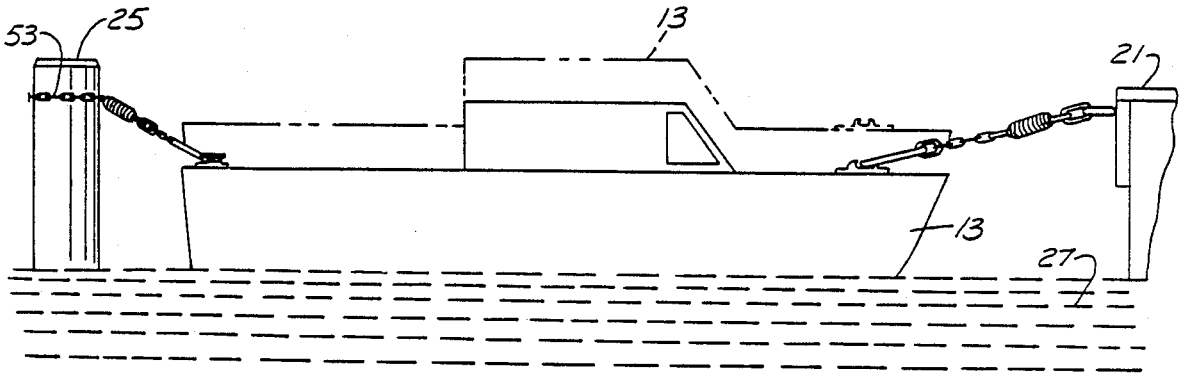
FIG. 2

YIELDABLE MOORING LINE FOR A BOAT

FIELD OF THE INVENTION

This invention relates to mooring lines for boats and more particularly to a yieldable mooring line to safely space a boat relative to a dock and pilings.

BACKGROUND OF THE INVENTION

Previously, there has always existed the problem of safely mooring a boat with respect to a dock and pilings or other protected area in order to safely retain the boat at its opposite ends from forcible engagement with the dock, piling or other obstruction to which the boat is anchored. This is usually accomplished by a plurality of lines extending from opposite ends of the boat to the dock or piling in order to space the boat from the dock, piling or other anchorage to protect it against wind, waves and changing water levels.

Previously, various types of line connections have been provided in an effort to solve the problem of protecting a boat against damage during high winds, storms or tornadoes in an effort to keep the boat from contacting the dock or pilings.

Previously, mooring lines have been provided which have been unable to sustain the heavy weights of boats. In many cases, and during storms and high winds, mooring lines are broken resulting in the boat being damaged by banging against the docks, pilings or other anchorages.

SUMMARY OF THE INVENTION

An important feature of the present invention is to provide a yieldable mooring line or a plurality of such lines for a boat which yieldably supports and centers a boat with respect to a dock and pilings to protect the boat against engagement therewith during high winds, waves, and drastic water level changes.

Another feature of the present invention is to provide a yieldable mooring line which has the capability of yielding under tension to avoid breakage of the mooring line and to permit lateral and transverse displacement of the boat, but only sufficiently to keep the boat from contacting docks and pilings.

Still another feature of the present invention is to combine with a mooring line a tension spring and chain with suitable linkage for yieldably connecting the boat, bow and stern to spaced portions of a dock, catwalk and pilings to protect the boat against banging against such dock and pilings.

A further feature of the present invention is to provide for the yieldable mooring line an elongated coil spring having first and second spring key clevises connected to opposite ends of the spring and projecting therefrom with a chain at one end connected to a first clevis. A line is removably anchored to the boat and a snap-on secured to one end of the line is removably connected to the other end of the chain while the second spring key clevis is adapted for connection to a dock or piling.

A still further feature of the present invention is to provide first and second spring key clevises which axially project into and are retained within opposite end portions of the coiled tension spring and which provide connections to a chain for connection to a line connected to the boat and for connection to a chain anchored to a dock or piling.

These and other features and objects will be seen from the following specification and claims in conjunction with the appended drawings.

THE DRAWINGS

FIG. 1 is a fragmentary plan view of the mooring of a boat with respect to a dock, catwalk and pilings, employing the present yieldable mooring line.

FIG. 2 is a side elevational view of the boat and its mooring lines.

Figure 3:
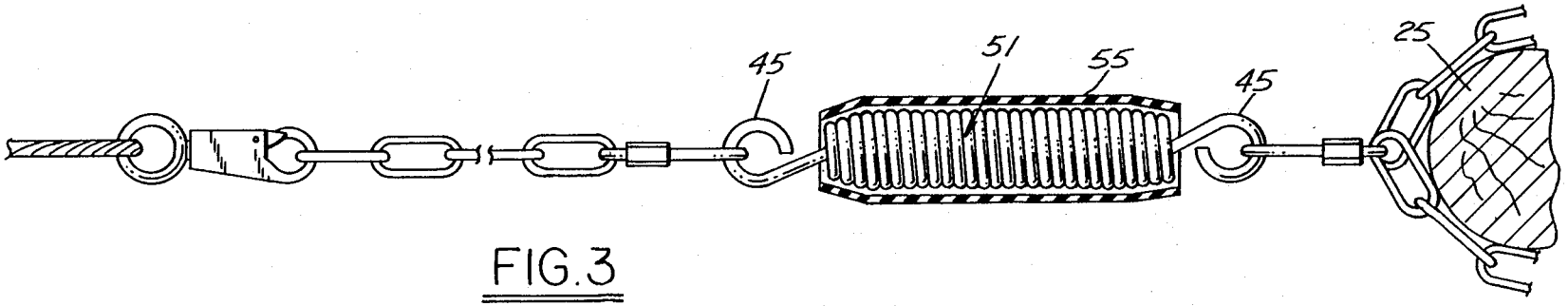
FIG. 3 is a side view of the present yieldable mooring line shown in FIG. 1, on an increased scale and with the spring untensioned.

It will be understood that the above drawings illustrate merely a preferred embodiment of the invention, and that other embodiments are contemplated within the scope of the claims hereafter set forth.

DETAILED DESCRIPTION OF THE PREFERRED EMBODIMENT OF THE INVENTION

Referring to the drawings, the present yieldable mooring for boats generally indicated at 11, FIG. 1, designates a boat at 13 which may be a cruiser or any other type having a conventional bow cleat 15, a pair of laterally spaced chocks 17, and a pair of laterally spaced stern cleats 19. Boat 13 is shown moored in FIG. 1 with respect to dock 21, fragmentarily shown, catwalk 23 and the spaced pilings 25 with respect to the body of water 27.

A pair of longitudinally spaced eye bolts 29 are secured to the dock 21, and are sometimes referred to as dock eyes, and are adapted for connection of the one ends of the present yieldable mooring line. Eye bolts 31 are similarly secured to the corresponding pilings 25 adapted for connection of the one ends of the yieldable mooring lines for the boat. With respect to the above-described, otherwise conventional apparatus on boat 13 respective yieldable mooring lines 11 in the illustrative embodiment are semi-permanently connected to the dock 21 and piling 25 for removable connection to the bow and stern of the boat.

In the illustrative embodiment, the yieldable mooring for the bow end of the boat includes a single line or rope 33 including a central eye splice 35 which is removably positioned over the bow cleat 15 with portions of the line outwardly thereof threaded through the slotted chocks 17. The line 33 terminates in the spliced end thimbles 37 or other ring which is fixedly connected to the respective ends of the line 33.

Figure 4:
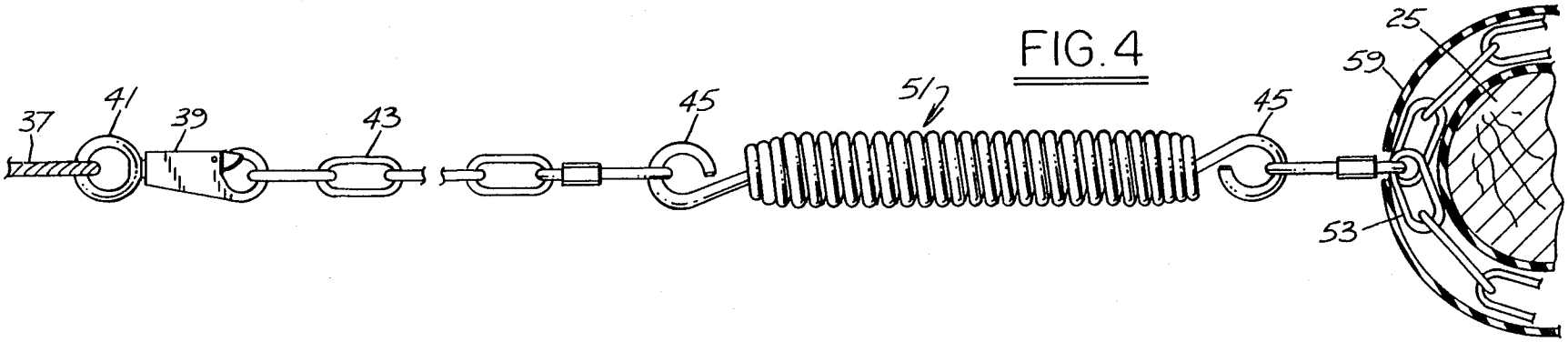
FIG. 4 is a view similar to FIG. 3, with the spring shown under tension and partly expanded.

As shown in FIGS. 1, 3 and 4, a snap-on 39 with connected eye 41 is connected to thimble 37 and has a removable clasp connection to one end of chain 43. The other end of the chain 43 is connected to the first spring key clevis 45 of general S-shape, with the extreme ends of the S-shape being bent inwardly to almost contact the body of the S-shape, resulting in an 8-shape, FIG. 5. The first spring key clevis 45 at one end has a reverse-turned anchor loop 47 which is projected within a throated reduced-sized axial opening 48 at the respective ends of the coil tension spring 51. In the present illustration, the tension spring 51 is constructed of stainless steel. The coil spring 51 at its opposite ends has a series of adjacent coils 49 of decreasing diameter defining the throated opening 48, FIG. 5, into which the respective anchor loop 47 of the clevis 45 is forcibly projected and retained against disassembly. The reduced diameter allows the spring key clevises 45 to rotate with respect to spring 51. This provides the means by which the respective first and second spring key clevises 45 are axially projected into opposite ends of coil tension spring 51 and retained therein.

Figure 5:
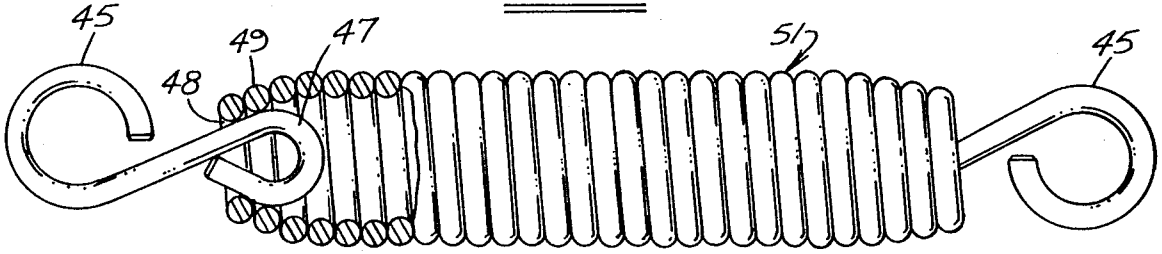
FIG. 5 is a fragmentary longitudinal section of the present tension spring on an increased scale, illustrating the connection of the first and second spring key clevises thereto.

The second spring key clevis 45 on the right side of the coil spring 51 shown in FIGS. 3, 4 and 5 has connected thereto one end of chain 53. The other end of the chain 53 in the case of the piling 25 at the catwalk 23 extends around the corresponding piling for anchoring the adjacent yieldable mooring line 11. Each of the other three mooring lines to the corresponding second spring key clevis 45 are connected to corresponding eye bolts 29 and 31 by a suitable link, connector or snap-on 54.

In the illustration of the tension spring 51 in FIG. 3 there is mounted upon, around and retained thereon a protective sleeve 55 of a flexible material such as rubber or plastic. The purpose of the sleeve is to protect the user's fingers from pinching between the respective coils of the spring 51 when extended or under tension. As shown in FIG. 4, surrounding the chain 53 is a protective hose 59 of rubber or plastic material.

The respective yieldable moorings 11 for the stern of the boat 13 are of a similar construction, except that instead of the single line 33 retained over the bow cleat 15, there are instead a pair of stern lines 57 with connector loops 61 thereon which are removably positioned over the stern cleats 19. These are short lines which at their other ends have spliced end thimbles 37 connected as by a snap 39, 41 to one end of the chain 43 such as shown in FIG. 4. The other end of the chain 43 is connected to adjacent spring key clevis 45 and swively connected to the tension spring 51. The second spring key clevis 45 on the opposite end of the spring 51 is connected to the eye bolt 31 on the piling 25 in the two illustrations shown in FIG. 1.

In the illustrated embodiment, the respective pair of yieldable mooring lines 11 for the bow end of the boat 13 are inclined forwardly and outwardly at an angle of approximately 90 degrees for a semi-permanent anchorage to the dock eyes 29. The yieldable mooring lines 11 for the stern of the boat 13 similarly extend angularly outward at an angle of approximately 90 degrees with their outer ends semipermanently connected to the respective pilings 25.

In normal usage, the stern lines are first removed from the corresponding stern cleats 19 and either suspended from the adjacent piling 25 or hooked thereon. As a final step, the central eye splice 35 of the line 33 is disconnected from the corresponding bow cleat 15, and the entire assembly of the pair of yieldable moorings 11 is thrown onto the dock 21. Alternately, the line 33 may remain on the boat 13 with the respective thimbles 37 disconnected from the corresponding chains 43 by the use of the snap-on 39.

The respective yieldable moorings may lie in a single plane or may be inclined depending upon the water level for the most efficient use of the present yieldable mooring lines for the boat or cruiser 13.

In the assembly of the respective mooring lines 11 to the respective bow and stern ends of the boat, initially there is provided some slack in the assembly so it is not tight to thereby permit the corresponding springs 51 to take up any axial forces with some spring tension or expansion such as shown in FIG. 4 so that the boat is yieldably and safely suspended in the dockage area shown in FIG. 1 between dock 21, the catwalks 23 and the corresponding pilings 25. The respective yieldable mountings can be inclined or horizontal so as to save wear on the respective lines and to minimize chafing.

The novel helical or coil extension spring 51 as used in the present invention has the following specifications:

| | |
|---|---|
| Spring Material | Stainless Steel 302 |
| Recommended max. work stress | 85000 PSI |
| Modulus of rigidity | 10000000 PSI |
| Outside diameter | 2.200 IN |
| Inside diameter | 1.538 IN |
| Preload | 100.000 LBS |
| Max. travel | 1.000 IN |
| Max. load (at max. extension). | 205.000 LBS |
| Wire diameter | 0.331 IN |
| Number of turns | 21.89 TURNS |
| Solid length | 7.245 IN |
| Extended length | 8.245 IN |
| Spring rate | 105.00 LB/IN |
| Stress under max. load | 341.77 PSI |
| Approximate weight | 3.1628 LBS |

There are many advantages to the yieldable mooring lines described herein. First, the chafing or cutting of rope mooring lines is eliminated. In addition the novel mooring lines prevent excessive longitudinal or force and aft movement of the boat during excessive weather conditions. In one storm when my cruiser (overall length of 30 feet, beam of 11 feet and weight of over 7,000 pounds) was in a boat well (13 feet by 36 feet) the cruiser moved up and down, to and from without touching the dock or the pilings. With the west/southwest winds, most of the weight and pulling was on the aft port spring which did not open more than ¼ of an inch during the storm. Other boats subjected to generally the same adverse weather conditions were trying to get on the dock; mooring lines were broken; and other boats were banging against the docks and pilings.

Having described my invention, reference should now be had to the following claims.

I claim:

1. A yieldable mooring arrangement for a boat comprising a coiled spring having a longitudinal axis;

a boat;

a first and second spring key clevis connected to opposite ends of said spring upon said axis and projecting therefrom;

a chain at one end connected only to the first clevis;

a line removably anchored to said boat;

a snap-on secured upon one end of said line and removably connected only to the other end of said chain;

said second spring key clevis connected to a dock or piling;

each of said first and second spring, key clevises being swively retained upon said axis within the respective ends of said spring and rotatable relative to said spring thus allowing relative rotation between said dock or piling, said spring and said chain;

each of said spring key clevises being of general S-shape with the extreme ends of the S-shape being bent inwardly to almost contact the body of the S-shape resulting in an 8-shape having two loop ends, with one said loop end thereof projected into and retained within the end of said spring; and the coil ends of said spring being of decreasing diameter forming a throated opening at opposite ends of said spring;

said one looped end being oversized relative to said throated opening.

2. In the yieldable mooring arrangement of claim 1, said coil spring being constructed of stainless steel.

3. In the yieldable mooring arrangement of claim 1, said spring adapted to accept work stresses up to 85,000 psi.

4. In the yieldable mooring arrangement of claim 1, said spring under stress having a maximum travel over its length of one inch, approximately.

5. In the yieldable mooring arrangement of claim 1, the connection of the second key clevis to a dock including an eye bolt upon said dock connected to said second key clevis.

6. In the yieldable mooring arrangement of claim 5, the connection between said second key clevis and eye bolt including a snap-on.

7. In the yieldable mooring arrangement of claim 1, an elongated protective sleeve of a flexible material mounted over and enclosing said spring and retained thereon.

8. In the yieldable mooring arrangement of claim 7, said flexible material being selected from the group consisting of rubber and plastic.

9. In the yieldable mooring arrangement of claim 1, the connection of the second key clevis to a piling including a chain wrapped around the piling and connected to said second key clevis.

10. In the yieldable mooring arrangement of claim 9, a hose of flexible material enclosing and surrounding said piling chain.

11. A mooring arrangement for a boat having a central bow cleat and a pair of laterally spaced apertured side chocks, comprising:

a boat having a central bow cleat and a pair of laterally spaced apertured side chocks;

a line having an eye splice intermediate its ends removably anchored over said cleat with portions of said line guidably extending through said chocks and terminating in a pair of spliced end thimbles;

a pair of yieldable mooring lines connecting each end thimble to a dock or piling;

each yieldable mooring line including a coil spring having a longitudinal axis;

a first and second spring key clevis connected to opposite ends of said spring upon said axis and projecting therefrom;

a chain at one end connected to the first clevis;

a snap secured upon one end of said line and removably connected to the other end of said chain;

said second spring key clevis being conected to a dock or piling.

12. In the mooring arrangement for a boat defined in claim 11, the connection of each yieldable mooring line to a dock including laterally spaced eye bolts upon said dock, each of said second key clevises being connected to said eye bolts.

13. In the mooring assembly of claim 12, said pair of yieldable mooring arrangements diverging outwardly from the boat to the dock at right angles approximately.

14. A mooring for a boat having a stern cleat comprising:

a boat having a stern cleat;

a pair of lines each having a looped one end connected to said cleat and an eye spliced upon the other end of each said line;

a pair of yieldable mooring lines connecting each line to a piling, each yieldable mooring line including a coil spring having a longitudinal axis;

a first and second spring key clevis connected to opposite ends of said spring upon said axis and projecting therefrom;

a chain at one end connected to said first clevis; and a snap-on secured upon one end of each said line and removably connected to the other end of said chain;

said second spring key clevis being adapted for connection to a piling.

* * * * *